US006624806B2

(12) United States Patent
Hsu

(10) Patent No.: US 6,624,806 B2
(45) Date of Patent: Sep. 23, 2003

(54) JOYSTICK CAPABLE OF CONTROLLING DIRECTION RUDDER AND ACCELERATOR SYNCHRONOUSLY

(75) Inventor: Wei Hsu, Taipei (TW)

(73) Assignee: Weistech Technology Co., Ltd., Taipei Hsien (TW)

( * ) Notice: Subject to any disclaimer, the term of this patent is extended or adjusted under 35 U.S.C. 154(b) by 177 days.

(21) Appl. No.: 09/938,570

(22) Filed: Aug. 27, 2001

(65) Prior Publication Data

US 2003/0038781 A1 Feb. 27, 2003

(51) Int. Cl.[7] ..... G09G 5/08

(52) U.S. Cl. ..... 345/161; 74/471 XY; 273/148 B; 463/38

(58) Field of Search ..... 345/161, 157; 74/471 XY; 463/36–38; 341/20, 22; 273/148 B

(56) References Cited

U.S. PATENT DOCUMENTS 5,749,577 A * 5/1998 Couch et al. ..... 273/148 B
5,786,807 A * 7/1998 Couch et al. ..... 345/161
5,805,141 A * 9/1998 Hsu ..... 345/161
6,068,554 A * 5/2000 Tyler ..... 463/38
6,429,849 B1 * 8/2002 An et al. ..... 345/161

* cited by examiner

*Primary Examiner*—Richard Hjerpe
*Assistant Examiner*—Francis Nguyen
(74) *Attorney, Agent, or Firm*—Leong C. Lei

(57) ABSTRACT

A joystick structure includes an ergonomic handle, a base on which is mounted the handle, and a mini joystick fitted in a cavity of the handle and including a button and a direction control unit, the direction control unit being provided with a control rod which is movable in two perpendicular directions, the control rod being able to return to an original position thereof when released for controlling direction, the control rod being able to stop at any position for controlling acceleration, whereby the direction control unit and acceleration control unit can be operated synchronously.

2 Claims, 5 Drawing Sheets

JOYSTICK CAPABLE OF CONTROLLING DIRECTION RUDDER AND ACCELERATOR SYNCHRONOUSLY

BACKGROUND OF THE INVENTION

1. Field of the Invention

This invention is related to an improvement in the structure of a joystick and in particular to one which can control the direction control unit and acceleration control unit synchronously.

2. Description of the Prior Art

The conventional joystick is a computing lever controlling a cursor, i.e. a hand-held control stick that allows a player to control the movements of a cursor on a computer screen or a symbol in a video game. The conventional joysticks 100 (see FIGS. 5, 6 and 7) generally include a base 300, a handle 200 mounted on the base 300 and a plurality of function keys 400 arranged on the base 300. However, such joysticks suffer from the following drawback:

1. As shown in FIG. 6, the direction control unit is arranged within the handle and controlled by rotating the handle clockwise or counterclockwise. Nevertheless, as the handle 200 is also used for controlling the vector variation in X-axis and Y-axis and is controlled by the wrist, the handle 200 will often be operated in mistake. Furthermore, the handle is not ergonomically designed and will often cause injury to the user.
2. As shown in FIGS. 5 and 7, the direction control unit is either arranged on the handle or the base. Nonetheless, it is necessary for a user to use his left or right hand finger to control the direction control unit so that when the user controls the direction control unit, he will be very difficult to control other function keys.
3. In addition, the direction control unit and the acceleration control unit of the conventional joysticks are separately arranged in different positions thereby making it almost impossible to control the two units synchronously and also increasing the manufacturing cost.

Therefore, it is an object of the present invention to provide an improved joystick which can obviate and mitigate the above-mentioned drawbacks.

SUMMARY OF THE INVENTION

This invention is related to an improvement in the structure of a joystick.

It is the primary object of the present invention to provide an improved joystick which can be used for controlling the direction control unit and acceleration control unit synchronously.

It is another object of the present invention to provide an improved joystick which can be conveniently operated by one hand.

It is a further object of the present invention to provide an improved joystick which is compact in size and low in cost.

According to a preferred embodiment of the present invention, a joystick structure includes an ergonomic handle, a base on which is mounted the handle, and a mini joystick fitted in a cavity of the handle and including a button and a direction control unit, the direction control unit being provided with a control rod which is movable in two perpendicular directions, the control rod being able to return to an original position thereof when released for controlling direction, the control rod being able to stop at any position for controlling acceleration.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1:
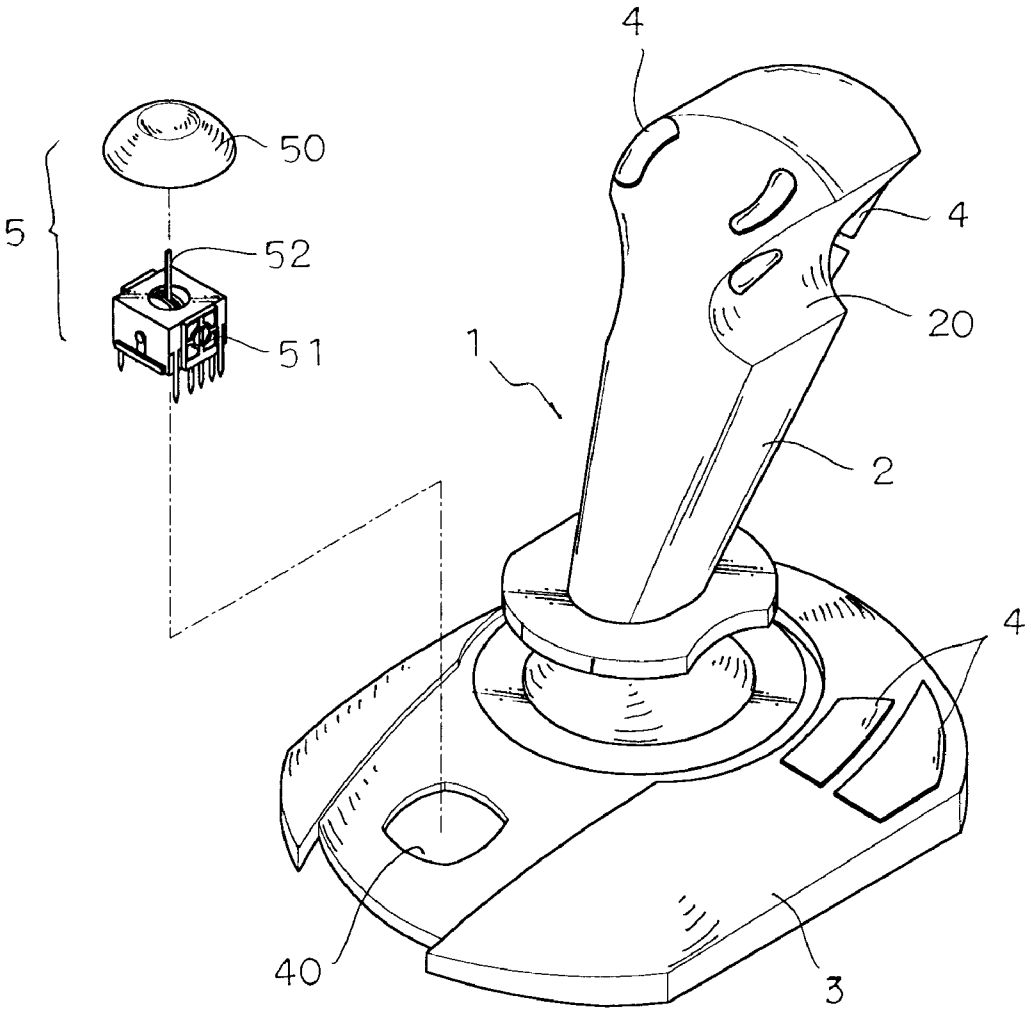
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 2:
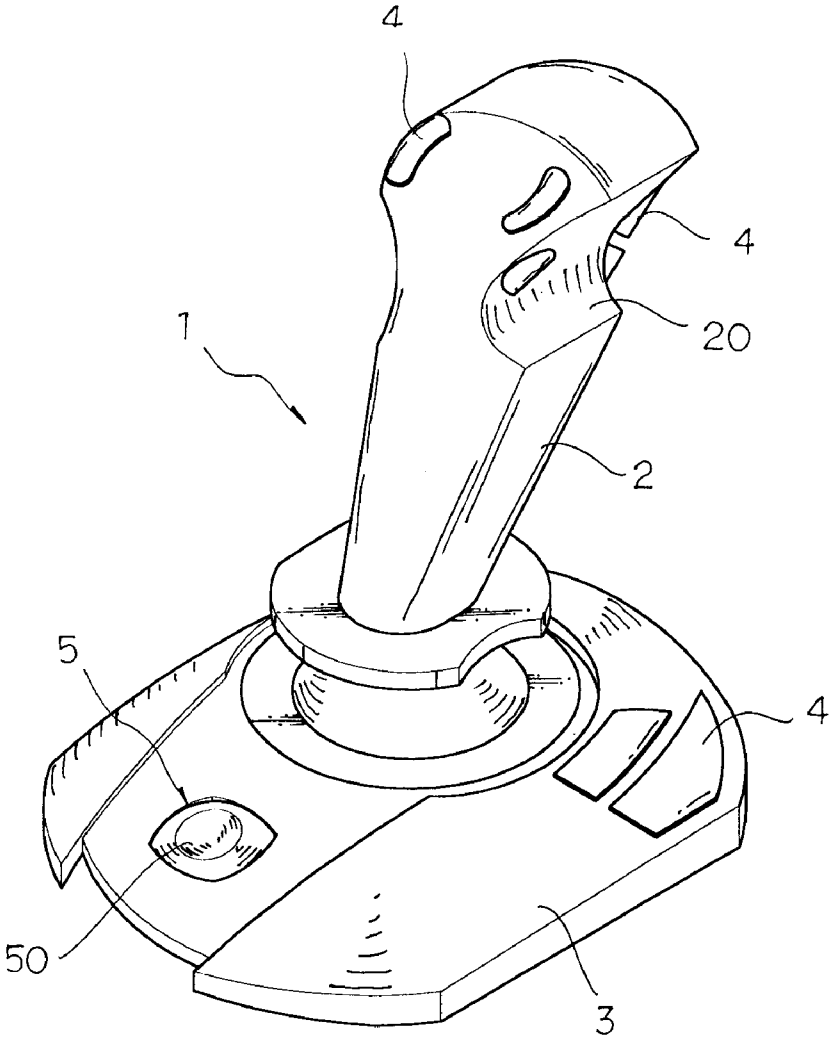
FIG. 2 is a perspective view of the present invention.
Figure 3:
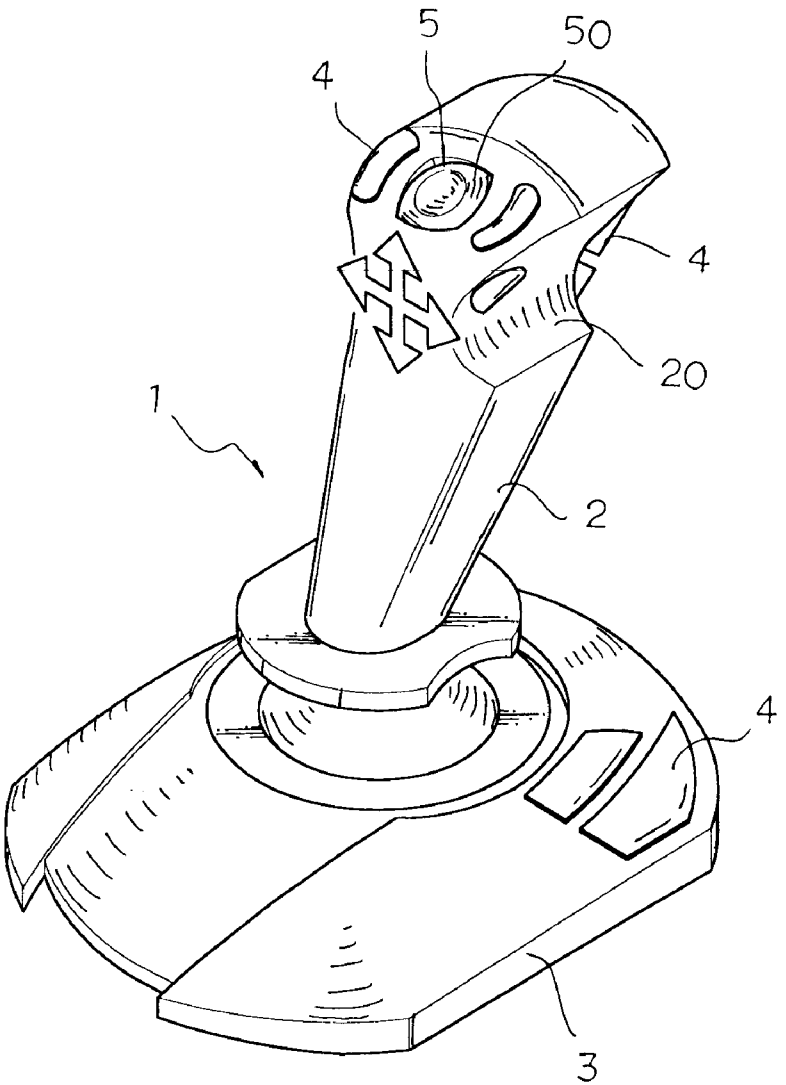
FIG. 3 illustrates a second preferred embodiment of the present invention.

With reference to the drawings and in particular to FIGS. 1, 2 and 3 thereof, the present invention generally comprises a handle 2, a base 3 and a mini joystick 5.

The handle 2 has an ergonomic shape designed for ease of use, i.e. for maximum comfort and efficiency. The handle 2 is formed with two curved recesses 20 for receiving fingers. A plurality of functions keys 4 is provided at the upper end of the handle 2 for increasing variation and fun in playing games.

The base 3 is designed so that it can stand firmly on a surface and may be provided with a slip-proof pad (not shown) at the bottom so as to increase the friction between the bottom of the base 3 and the surface. The handle 2 is mounted on the handle 2. The top of the base 3 is provided with a plurality of function keys 4 and a cavity 40.

Figure 4:
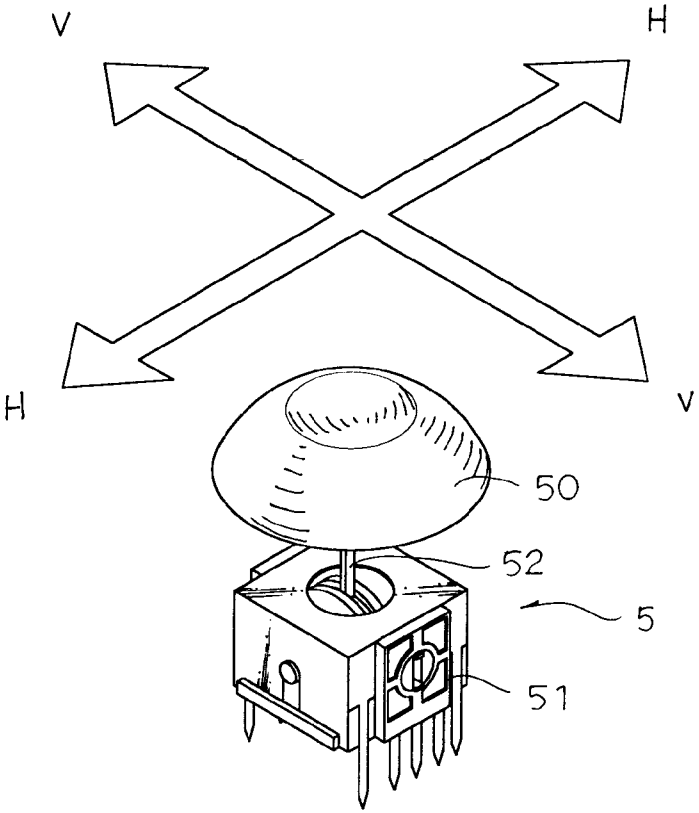
FIG. 4 illustrates the working principle of the present invention.
Figure 7:
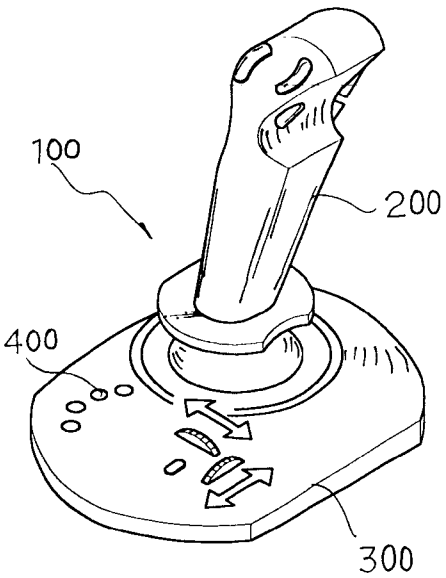
PRIOR ART Fig. 7
FIG. 7 illustrates a third prior art joystick.
Figure 6:
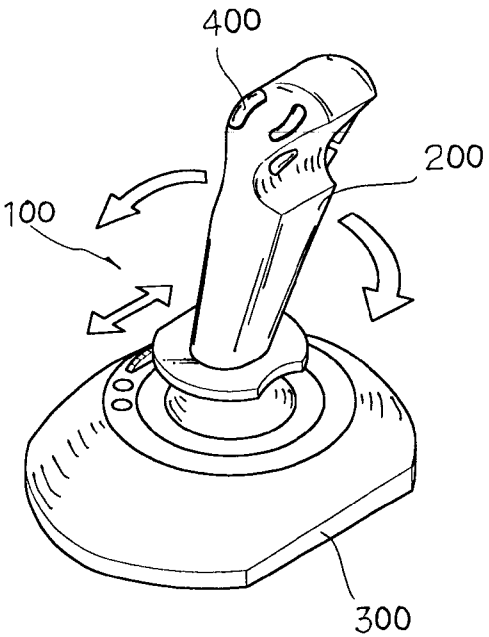
PRIOR ART Fig. 6
FIG. 6 illustrates a second prior art joystick.
Figure 5:
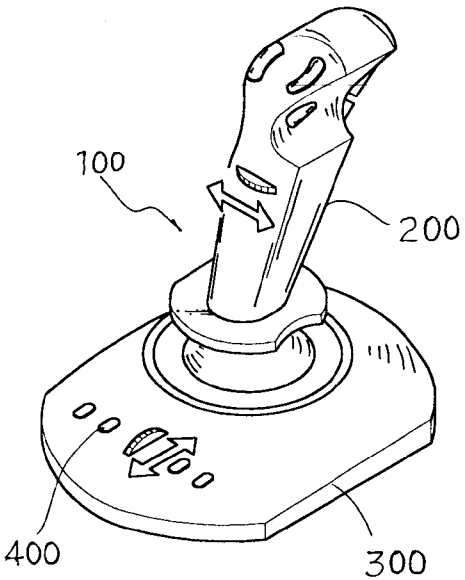
PRIOR ART Fig. 5
FIG. 5 illustrates a first prior art joystick.

The mini joystick 5 is fitted in the cavity 40 and comprises a button 50 and a direction control unit 51. The direction control unit 51 is provided with a control rod 52 which can be moved along the directions shown by arrows H and V in FIG. 4. The control rod 52 will return to its original position when moved along the direction shown by the arrow H and then released. However, the control rod 52 may stop at any position when moved along the direction shown by the arrow V.

The mini joystick 5 is not necessarily fitted in the cavity 40 and may be arranged in any other position which is convenient for a user. Further, the cavity 40 may be formed in the handle 4 so as to comply with the desire of the user (see FIG. 3).

As shown in FIG. 3, when in use, the user may hold the handle 2, use only one of his or her fingers to control the mini joystick 5, and other fingers to control function keys 4, thereby enabling a user to use the handle 2 to control acceleration, the mini joystick 5 to control direction as well as the function keys 4 to control other functions synchronously and therefore making the game more interesting and providing more fun.

In conclusion, the present invention has the following advantages over the prior art:

3. Controlling the Direction Control Unit and Acceleration Control Unit Synchronously:

The direction control unit is provided with a control rod which can be moved along the directions shown by arrows H and V, wherein the control rod will return to its original position when moved along the direction shown by the arrow H and then released, and the control rod may stop at any position when moved along the direction shown by the arrow V.

4. Fit for Economical Profit and Compact in Size:

The present invention combines control units supplied by different manufacturers into one unit thereby facilitating the manufacture, lowering the cost and increasing the production.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A joystick structure comprising:

an ergonomic handle;

a base on which is mounted said handle; and a mini joystick fitted in a cavity of said handle and comprising a button and a direction control unit, said direction control unit being provided with a control rod which is movable in two perpendicular directions, said control rod being able to return to an original position thereof when released for controlling direction, said control rod being able to stop at any position for controlling acceleration.

2. A joystick structure comprising:

an ergonomic handle;

a base on which is mounted said handle, said base being formed with a cavity; and a mini joystick fitted in said cavity of said handle and comprising a button and a direction control unit, said direction control unit being provided with a control rod which is movable in two perpendicular directions, said control rod being able to return to an original position thereof when released for controlling direction, said control rod being able to stop at any position for controlling acceleration.

* * * * *